US008038255B2

(12) United States Patent
Watanabe et al.

(10) Patent No.: US 8,038,255 B2
(45) Date of Patent: Oct. 18, 2011

(54) CAP MEMBER AND FLUID EJECTING APPARATUS

(75) Inventors: Eiichiro Watanabe, Matsumoto (JP); Tsutomu Kobayashi, Shiojiri (JP); Shuichi Koganehira, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 494 days.

(21) Appl. No.: 12/234,129

(22) Filed: Sep. 19, 2008

(65) Prior Publication Data

US 2009/0079786 A1 Mar. 26, 2009

(30) Foreign Application Priority Data

Sep. 20, 2007 (JP) ..... 2007-243837

(51) Int. Cl.
*B41J 2/165* (2006.01)

(52) U.S. Cl. ..... 347/29

(58) Field of Classification Search ..... 347/29, 347/31

See application file for complete search history.

(56) References Cited

U.S. PATENT DOCUMENTS 7,244,013 B2 * 7/2007 Harada et al. ..... 347/29

FOREIGN PATENT DOCUMENTS

JP 2002-011864 1/2002

* cited by examiner

*Primary Examiner* — An Do

(74) *Attorney, Agent, or Firm* — Workman Nydegger

(57) ABSTRACT

A cap member according to a first aspect of the invention is a cap member that covers a nozzle area of an ejecting head having a plurality of nozzle openings for ejecting fluid. The cap member includes a cap member body having a bottom portion and a frame portion and an absorbing member being fixed to the bottom portion for absorbing the fluid. The bottom portion is arranged so as to oppose the nozzle area, and the frame portion is provided on a peripheral edge of the bottom portion and coming into contact with the ejecting head. An inner peripheral portion extending along the inner surface of the frame portion is a groove portion, and the height of the groove portion from the bottom portion is lower than the upper surface of the absorbing member over the entire circumference of the frame portion.

6 Claims, 6 Drawing Sheets

CAP MEMBER AND FLUID EJECTING APPARATUS

CROSS-REFERENCE TO RELATED APPLICATIONS

This application is based upon and claims the benefit of priority from prior Japanese Patent Applications No. 2007-243837, filed on Sep. 20, 2007, the entire contents of which are incorporated herein by reference.

BACKGROUND

1. Technical Field

The present invention relates to a cap member and a fluid ejecting apparatus.

2. Related Art

As an example of known fluid ejecting apparatuses which eject fluid, there is an ink jet printing apparatus. The ink jet printing apparatus is an apparatus that prints characters or images on a printing medium, and is adapted to eject ink from nozzles provided on a printhead (ejecting head) onto the printing medium. The ink jet printing apparatus includes a maintenance mechanism that maintains ejecting characteristics of the nozzles. The maintenance mechanism includes a component such as a cap member that prevents the interior of nozzles from being dried. The cap member includes a frame portion that surrounds a nozzle area of the printhead, and includes an absorbing member that absorbs ink provided on the entire surface of the frame portion.

However, in the configuration in which the absorbing member is arranged over the entire surface in the frame portion, there is a probability that ink remaining in the nozzles runs through the absorbing member and is attached to the frame portion when the cap member covers the nozzle area. When the nozzle area is covered by the cap member having the ink attached to the frame portion, the ink on the frame portion is attached to the nozzle area.

SUMMARY

An advantage of some aspects of the invention is that a cap member and a fluid ejecting apparatus which are able to prevent fluid from being attached to a nozzle area.

A cap member according to a first aspect of the invention is a cap member that covers a nozzle area of an ejecting head having a plurality of nozzle openings for ejecting fluid. The cap member includes a cap member body having a bottom portion and a frame portion and an absorbing member being fixed to the bottom portion for absorbing the fluid. The bottom portion is arranged so as to oppose the nozzle area, and the frame portion is provided on a peripheral edge of the bottom portion and coming into contact with the ejecting head. An inner peripheral portion extending along the inner surface of the frame portion is a groove portion, and the height of the groove portion from the bottom portion is lower than the upper surface of the absorbing member over the entire circumference of the frame portion.

Since the inner peripheral portion extending along the inner surface of the frame portion of the cap member body having the bottom portion and the frame portion is the groove portion, and the height of the groove portion from the bottom portion is lower than the upper surface of the absorbing member, the fluid is stored in the groove portion. Consequently, the fluid is prevented from running to the cap member body, and hence the fluid is prevented from being attached to the nozzle area.

Preferably, the bottom portion is provided with an aperture for sucking at a position corresponding to the groove portion.

Since the bottom portion of the cap member body is provided with the aperture for sucking at the position corresponding to the groove portion, the fluid in the cap member body is sucked the groove portion by being sucked. In this manner, in the configuration in which the fluid is positively stored in the groove portion, the fluid is prevented from being attached to the nozzle area further effectively.

Preferably, the absorbing member is arranged at the center of the frame portion in plan view with a predetermined distance provided from the frame portion, and air bubbles present in the groove portion are prevented from coming into contact with the ejecting head when the ejecting head and the cap member body come into contact with each other.

Preferably, the maximum width of the air bubbles present in the groove portion is smaller than the groove portion when the ejecting head and the cap member body come into contact with each other.

Since the absorbing member is arranged at the center of the frame portion in plan view with a predetermined distance provided from the frame portion, and the groove portion is a portion surrounded by the frame portion, the bottom portion, and the absorbing member. Therefore, the depth of the groove portion formed between the frame portion and the absorbing member can be increased. Accordingly, the fluid is reliably stored in the groove portion.

Preferably, the absorbing member includes a first absorbing layer provided over substantially the entire surface in the frame portion and a second absorbing layer laminated on the first absorbing layer and arranged at the center of the first absorbing layer in plan view, and the groove portion is a portion surrounded by the frame portion, the first absorbing layer, and the second absorbing layer.

Since the absorbing member includes the first absorbing layer provided over substantially the entire surface in the frame portion and the second absorbing layer laminated on the first absorbing layer and arranged at the center of the first absorbing layer in plan view, and the groove portion is the portion surrounded by the frame portion, the first absorbing layer, and the second absorbing layer, the fluid absorbed by the groove portion is absorbed by the second absorbing layer. In this manner, the fluid is prevented from running along the cap member body further reliably by absorbing the fluid in the groove portion.

Preferably, the absorbing member is arranged at the center of the frame portion in plan view with a predetermined distance provided from the frame portion, and the groove portion is a portion surrounded by the frame portion, the bottom portion, and the absorbing member.

Since the absorbing member is arranged at the center of the frame portion in plan view with a predetermined distance provided from the frame portion, and the groove portion is the portion surrounded by the frame portion, the bottom portion, and the absorbing member, the depth of the groove portion formed between the frame portion and the absorbing member can be increased. Accordingly, the fluid is reliably stored in the groove portion.

A fluid ejecting apparatus according to a second aspect of the invention includes an ejecting head having a plurality of nozzle openings for ejecting fluid; and a cap member that covers a nozzle area of the ejecting head having the plurality of nozzle openings, wherein the cap member is the cap member according to the first aspect of the invention.

Since the ejecting head having the plurality of nozzle openings for ejecting fluid and the cap member that covers the nozzle area of the ejecting head having the plurality of nozzle openings are provided, and the cap member according to the second aspect of the invention is used, the fluid is prevented from being attached to the ejecting head and a burden of maintenance such as cleaning of the ejecting head is alleviated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
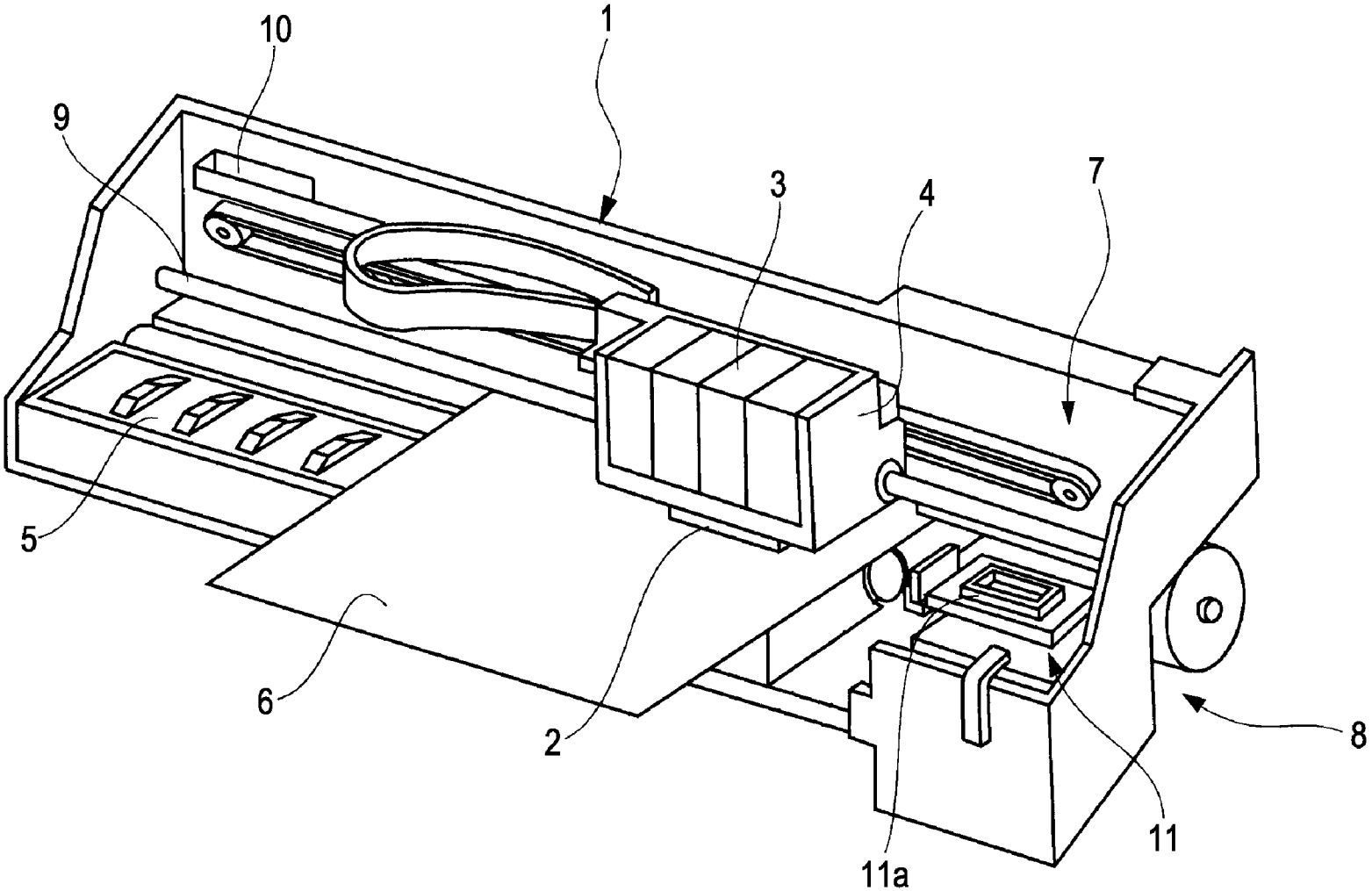
FIG. 1 is a schematic drawing showing a configuration of a printer according to an embodiment of the invention.

Referring now to the drawings, an embodiment of the invention will be described. In the respective drawings used for the description given below, the members are shown in different scaling as needed in order to make the respective members recognizable. In the embodiment, an ink jet printer is described as an example of a fluid ejecting apparatus according to an aspect of the invention.

FIG. 1 is a perspective view schematically showing a configuration of a printer 1 according to the embodiment.

As shown in FIG. 1, the printer 1 includes a carriage 4 having a head 2 as a kind of a liquid ejecting head mounted thereon and an ink cartridge 3 as a kind of a liquid storage member detachably mounted thereon, a platen 5 disposed below the head 2 and to which a printing sheet 6 is transported, a carriage moving mechanism 7 that moves the carriage 4 in a paper-width direction of the printing sheet 6, and a paper feeding mechanism 8 that transports the printing sheet 6 in a paper-feeding direction. A control device (not shown) for controlling the operation of the entire printer 1 is also provided. The paper-width direction corresponds to a primary scanning direction (head scanning direction). The paper-feeding direction corresponds to a secondary scanning direction (direction orthogonal to the primary scanning direction). The ink cartridge 3 is not limited to those to be mounted on the carriage 4 as in the embodiment, but may be those of a type being mounted on the casing of the printer 1 for supplying ink to the head 2 via an ink supply tube.

A guide rod 9 is a supporting member bridged in the primary scanning direction. The carriage 4 is mounted to the guide rod 9 in a state of being supported thereby. The carriage 4 is adapted to move in the primary scanning direction along the guide rod 9 by the carriage moving mechanism 7. A linear encoder 10 detects the position of the carriage 4 in the primary scanning direction. The detected signal is transmitted to a controller (not shown) as positional information. The controller recognizes the scanning position of the head 2 on the basis of the positional information from the linear encoder 10, and controls a printing operation (discharging operation) by the head 2.

A home position which is an original point of scanning for the head 2 is set in a moving area of the head 2 outside the platen 5. A capping mechanism 11 is provided at the home position. The capping mechanism 11 seals a surface of the head 2 having nozzle openings by a cap member 60 to prevent ink solvent from evaporating. The capping mechanism 11 is also used for a cleaning operation which forcedly sucks and discharges ink by exerting negative pressure on the nozzle opening surface in the sealed state.

Figure 2:
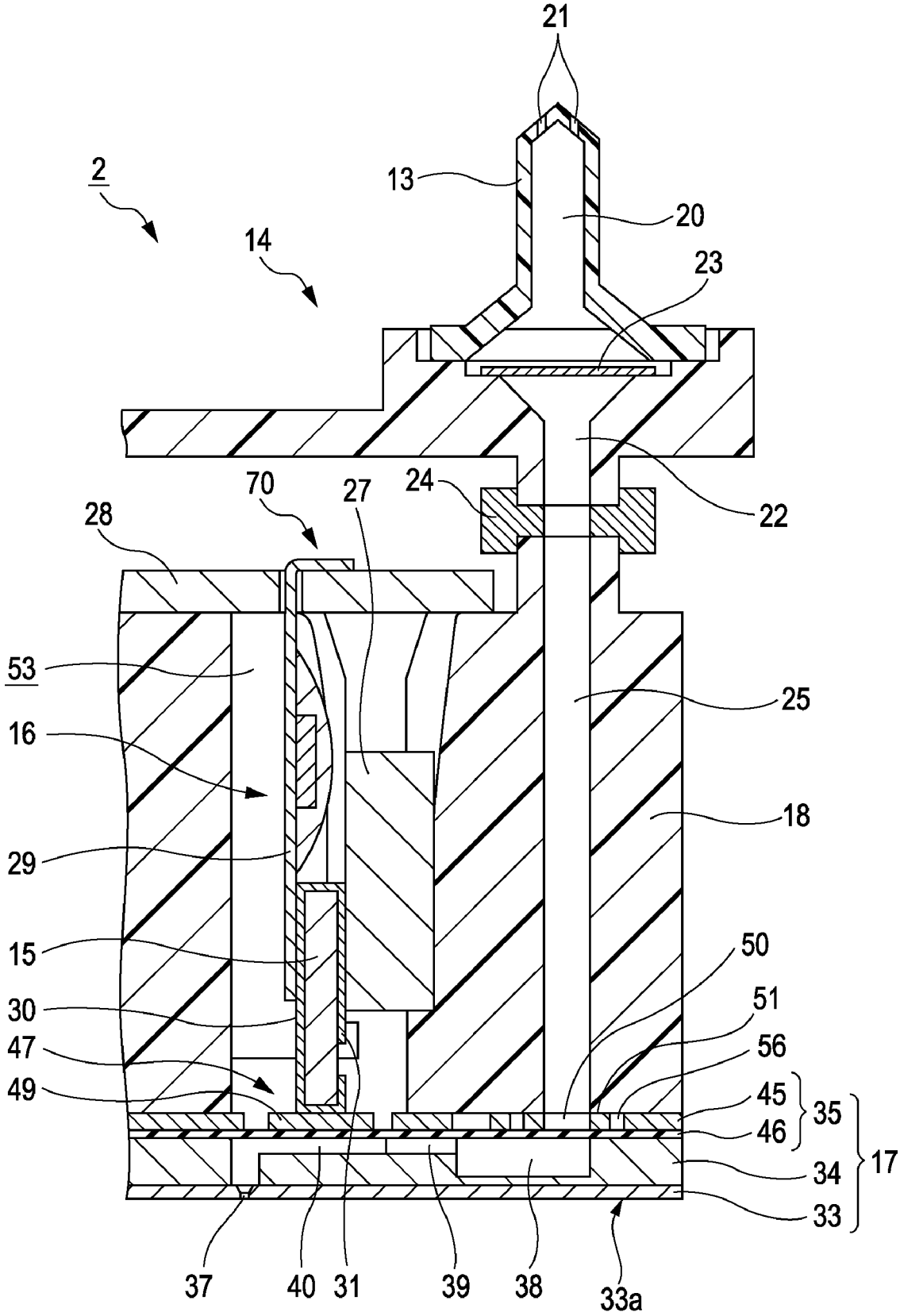
FIG. 2 is a plan view showing a principal portion of a periphery of a head.

FIG. 2 is a cross-sectional view schematically showing a configuration of the head 2.

As shown in FIG. 2, the head 2 includes an introduction needle unit 14 having an ink introduction needle 13 extending upright therefrom, an oscillator unit 16 having a plurality of piezoelectric oscillators 15, a flow channel unit 17 formed with an ink flow channel, a head case 18 for fixing the oscillator unit 16 and the flow channel unit 17, and a circuit substrate 28 formed of glass epoxy for supplying drive signals to the piezoelectric oscillators 15.

The ink introduction needle 13 is a molded member of a hollow needle shape formed of synthetic resin. The internal space of the ink introduction needle 13 corresponds to a needle flow channel 20 in which ink in the liquid storage member such as an ink cartridge or a sub tank, not shown, is introduced. The ink introduction needle 13 is provided with an introduction hole 21 at a pointed end thereof so as to communicate with the needle flow channel 20. The ink in the liquid storage member is introduced to the needle flow channel 20 through the introduction hole 21 in a state in which the ink introduction needle 13 is inserted into the interior of the liquid storage member.

The introduction needle unit 14 is formed of synthetic resin molded in the same manner as the ink introduction needle 13. An ink introduction channel 22 corresponding to the ink introduction needle 13 is formed in the interior of the introduction needle unit 14. An upstream end of the ink introduction channel 22 is formed into a shape increasing in diameter gradually toward the position where the introduction needle is mounted. A filter 23 for removing foreign substances in the ink is provided at an opening of the ink introduction channel 22. The ink introduction needle 13 is fixed on the introduction needle unit 14 in such a manner that the opening on the lower side of the needle flow channel 20 and the opening on the upper side of the ink introduction channel 22 are overlapped in plan view, so that the ink introduction channel 22 of the introduction needle unit 14 and the needle flow channel 20 of the ink introduction needle 13 communicate with each other via the filter 23.

The oscillator unit 16 includes the piezoelectric oscillators 15, a fixed panel 27 to which the piezoelectric oscillators 15 is joined, and a flexible substrate 29 that supplies drive signal from the circuit substrate 28 to the piezoelectric oscillators 15. The piezoelectric oscillators 15 each are a laminated piezoelectric oscillator formed by a laminating piezoelectric member between electrodes and cutting the same into elongated comb teeth shape. The piezoelectric oscillators 15, employing a vertically oscillating system, are able to be expanded and contracted in the vertical direction. The piezoelectric oscillators 15 each are joined at a fixed end thereof to the fixed panel 27, and are projected at a free end thereof outward from the distal edge of the fixed panel 27.

An independent external electrode 30 and a common external electrode 31 are provided on the surface of the each piezoelectric oscillator 15. The independent external electrode 30 is an electrode formed from the distal end surface of the piezoelectric oscillator 15 to a wiring connecting surface as one side surface of the piezoelectric oscillator 15 in the direction of lamination (a surface to which the flexible substrate 29 is connected), and is electrically connected to the independent internal electrode (not shown) in the interior of the piezoelectric oscillator 15. The common external electrode 31 is a electrode formed over the proximal surface portion of the piezoelectric oscillator 15 and a fixed panel mounting surface, which is the other side surface of the piezoelectric oscillator 15 in the direction of lamination, and is electrically connected to a common internal electrode (not shown) in the piezoelectric oscillator 15.

One of the external electrodes, that is, the independent external electrode 30 is electrically connected to an independent terminal of the flexible substrate 29, and the other one of the external electrodes, that is, the common external electrode 31 is electrically connected to a grounding terminal of the flexible substrate 29. A drive signal from the flexible substrate 29 is supplied to the piezoelectric oscillator 15 via the independent external electrode 30, and the potential difference between the independent external electrode 30 and the common external electrode 31 deforms the piezoelectric member.

The flow channel unit 17 integrally includes a nozzle plate 33, a flow channel formed substrate 34, and a sealing panel 35. The nozzle plate 33 is arranged on one of the surfaces of the flow channel formed substrate 34 and the sealing panel 35 is arranged on the other surface of the flow channel formed substrate 34 which is the opposite from the nozzle plate 33.

The nozzle plate 33 is a thin plate member formed of stainless steel having a plurality of nozzle openings 37 arranged in row in a nozzle area 33*a*. The flow channel formed substrate 34 is a plate-shaped member formed of, for example, a silicon wafer, and includes a flow channel base portion which is a series of ink flow channel composed of a common ink chamber 38, ink supply ports 39, and pressure chambers 40. The pressure chambers 40 each are arranged in such a manner that the direction orthogonal to the direction of arrangement of the nozzle openings 37 (the direction of row of the nozzle openings) is oriented in the longitudinal direction. The ink supply ports 39 each are formed as a narrowed portion (orifice) having a narrow flow channel which communicates the each pressure chamber 40 with the common ink chamber 38. The common ink chamber 38 is a chamber for storing ink introduced from the ink introduction needle 13 and supplied via the ink introduction channel 22 and the case flow channel 25 temporarily. The ink stored in the common ink chamber 38 is supplied to the respective pressure chambers 40 via the ink supply port 39.

The sealing panel 35 is a double-structure composite plate member formed by laminating a resilient film 46 formed of a flexible film having an insulating property such as PPS (polyphenylene sulfide) on a supporting substrate 45 having a conductivity such as stainless steel. The surface on the side of the resilient film 46 is joined to the flow channel formed substrate 34, and the surface on the side of the supporting substrate 45 is jointed to the bottom surface of the head case 18, respectively. The sealing panel 35 is formed with a diaphragm section 47 for varying the capacity of the pressure chambers 40 by sealing the opening surfaces of the pressure chambers 40 on one side. The diaphragm section 47 includes island portions 49 for joining the distal end surfaces of the piezoelectric oscillators 15 so as to correspond to the each pressure chambers 40. The island portions 49 each are formed into an elongated block shape in the direction orthogonal to the row of the nozzle openings 37.

The head case 18 is a hollow block-shaped member formed of synthetic resin, and is joined to the flow channel unit 17. A storage chamber 53 for storing the oscillator unit 16 and a case flow channel 23 for supplying ink from the introduction needle unit 14 side to the flow channel unit 17 side is provided in the interior of the head case 18. The storage chamber 53 is formed so as to extend from the bottom surface of the head case 18 which serves as a flow channel unit mounting surface to the upper surface to which the introduction needle unit 14 and the circuit substrate 28 are attached so as to penetrate through the height direction of the head case 18. The diaphragm section 47 of the sealing panel 35 is arranged within the opening on the bottom surface of the storage chamber 53. The case flow channel 25 communicates with the common ink chamber 38 via an ink introduction hole 50. The bottom surface of the head case 18 is bonded to the surface of the sealing panel 35 on the supporting substrate 45 side.

The introduction needle unit 14 is attached to the head case 18 with the intermediary of a packing 24. The ink introduction channel 22 of the introduction needle unit 14 communicates with the case flow channel 25 of the head case 18 via the packing 24.

The circuit substrate 28 is arranged on the upper surface of the head case 18. The circuit substrate 28 is joined to the flexible substrate 29 at a joint portion 70.

Figure 3:
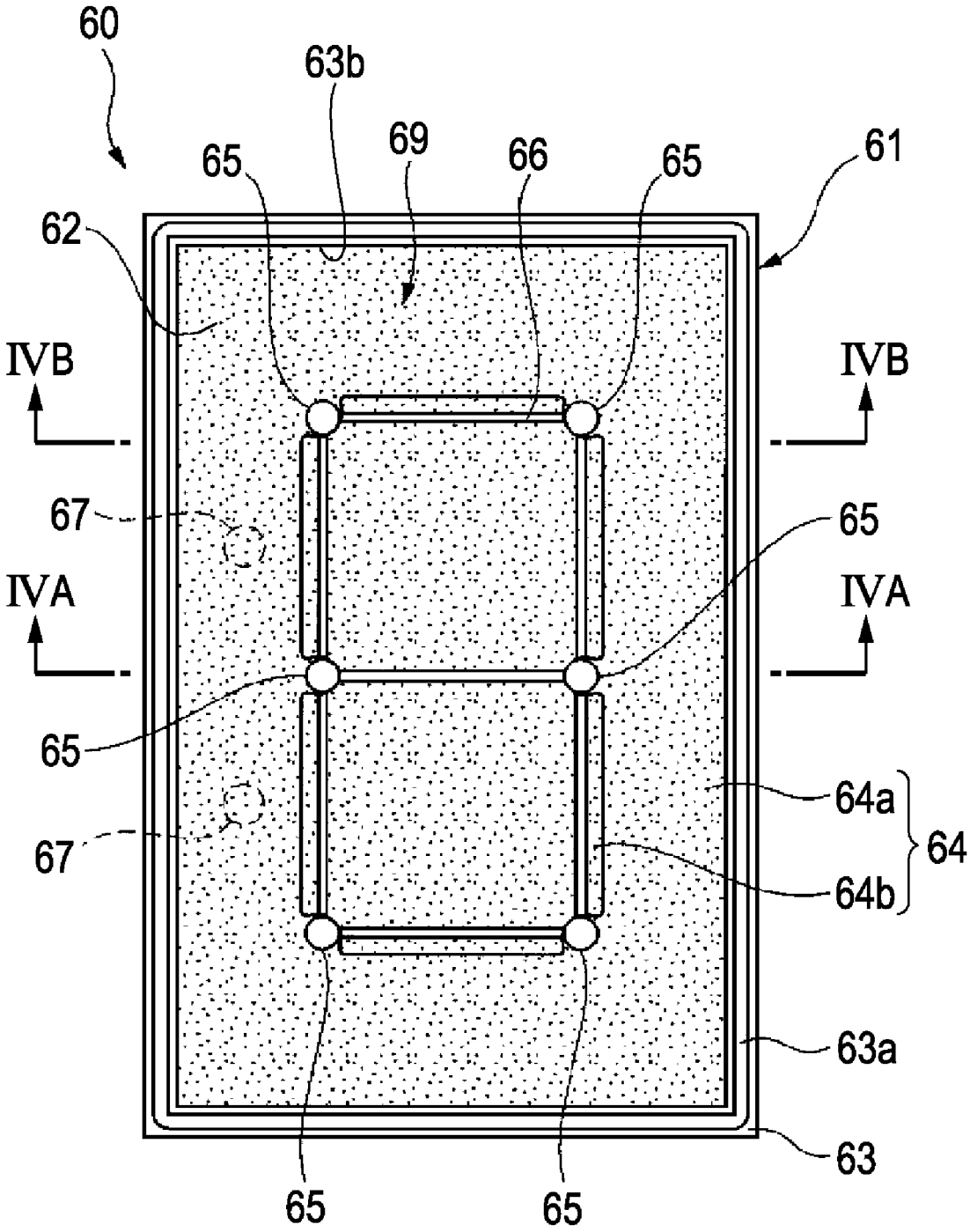
FIG. 3 is a plan view showing a cap member.
Figure 4A:
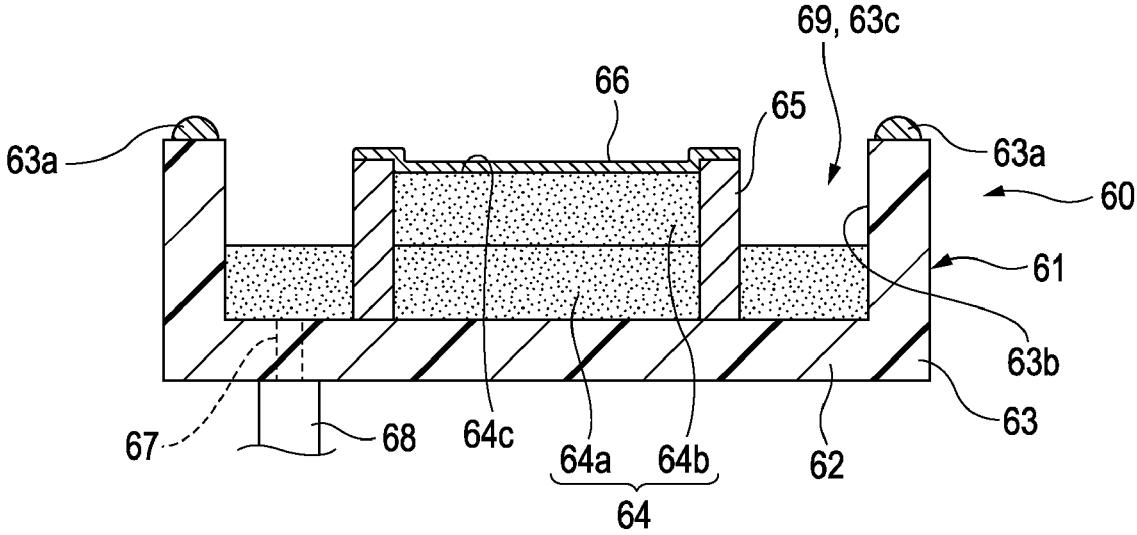
FIG. 4*a* and 4*b* are a cross-sectional view showing the cap member.
Figure 4B:
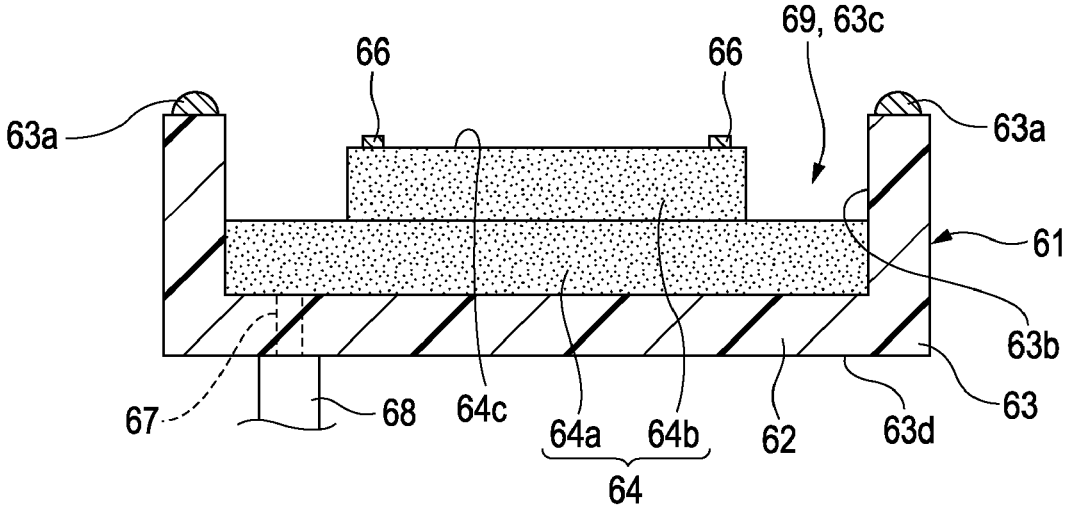

FIG. 3 is a side view showing a configuration of the cap member 60, which is a part of the capping mechanism 11. FIG. 4A is a cross-sectional view taken along the line IVA-IVA in FIG. 3, and FIG. 4B is a cross-sectional view taken along the line IVB-IVB in FIG. 3.

As shown in these drawings, the cap member 60 includes a cap member body 61 for covering part of the nozzle formed area of the head 2 and an absorbing member 64 fixed in the cap member body 61.

The cap member body 61 is formed of resin such as plastic, and includes a bottom portion 62 and a frame portion 63. The bottom portion 62 is formed into a rectangular shape in plan view, and is arranged so as to oppose the head 2. The frame portion 63 is formed along the peripheral edge of the bottom portion 62, and the frame portion 63 includes a sealing member 63*a* formed, for example, of elastomer or the like at an upper end thereof. The sealing member 63*a* abuts against the head 2.

The absorbing member 64 has a double-layer structure having a first absorbing layer 64*a* and a second absorbing layer 64*b*. The first absorbing layer 64*a* and the second absorbing layer 64*b* are laminated in sequence on the bottom portion 62 of the cap member body 61. The absorbing member 64 is fixed to the bottom portion 62 by, for example, a fixing pin 65 and the holding members 66.

The first absorbing layer 64*a* is bedded over the entire area on the bottom portion 62 surrounded, for example, by the frame portion 63, and is a rectangular shape in plan view. The second absorbing layer 64*b* is arranged at the center of the first absorbing layer 64*a* in plan view so as to provide an inner peripheral portion 63*c* formed along an inner surface 63*b* of the frame portion 63, and is formed into a rectangular shape in plan view. The second absorbing layer 64*b* is formed with recesses one each at four corners and one each at the centers of the long sides of the second absorbing layer 64*b* so as to be depressed toward the center of the second absorbing layer 64*b* in plan view. The height from the bottom portion 62 of a portion surrounded by the frame portion 63, the first absorbing layer 64*a*, and the second absorbing layer 64*b* (the inner peripheral portion 63*c* of the frame portion 63) is lower than an upper surface 64*c* of the second absorbing layer 64*b*, and this portion corresponds to a groove portion 69 of the cap member 60.

The fixing pins 65 are provided so as to penetrate through the first absorbing layer 64*a*, and are fixed to the bottom portion 62. The fixing pins 65 are provided at positions of the recesses of the second absorbing layer 64*b*, and are fixed to the recesses of the second absorbing layer 64*b* so as to press from the outside toward the inside. For example, in FIG. 3, the six fixing pins 65 are arranged one each at four corners of the second absorbing layer 64*b* and one each at the centers of the long side of the second absorbing layer 64*b*. The holding members 66 are, for example, a linear member such as a wire. The holding members 66 are joined to the respective fixing pins 65 for example by thermal caulking, and are provided between the respective fixing pins 65 so as to hold the second absorbing layer 64*b* from the upper surface 64*c* of the second absorbing layer 64*b* toward the bottom portion 62.

The bottom portion 62 is provided with apertures 67 for suction at positions corresponding to the groove portion 69, that is, at positions overlapped with the groove portion 69. The two apertures 67 are provided, for example, at positions along one long side of the cap member body 61. The number of the apertures 67 may be one or three or more, and the apertures 67 may be provided at other positions as long as they are provided at positions overlapped with the groove portion 69. The bottom portion 62 is provided with a suction tube 68 connected to the aperture 67 on the side of a lower surface 63*d*.

Figure 5:
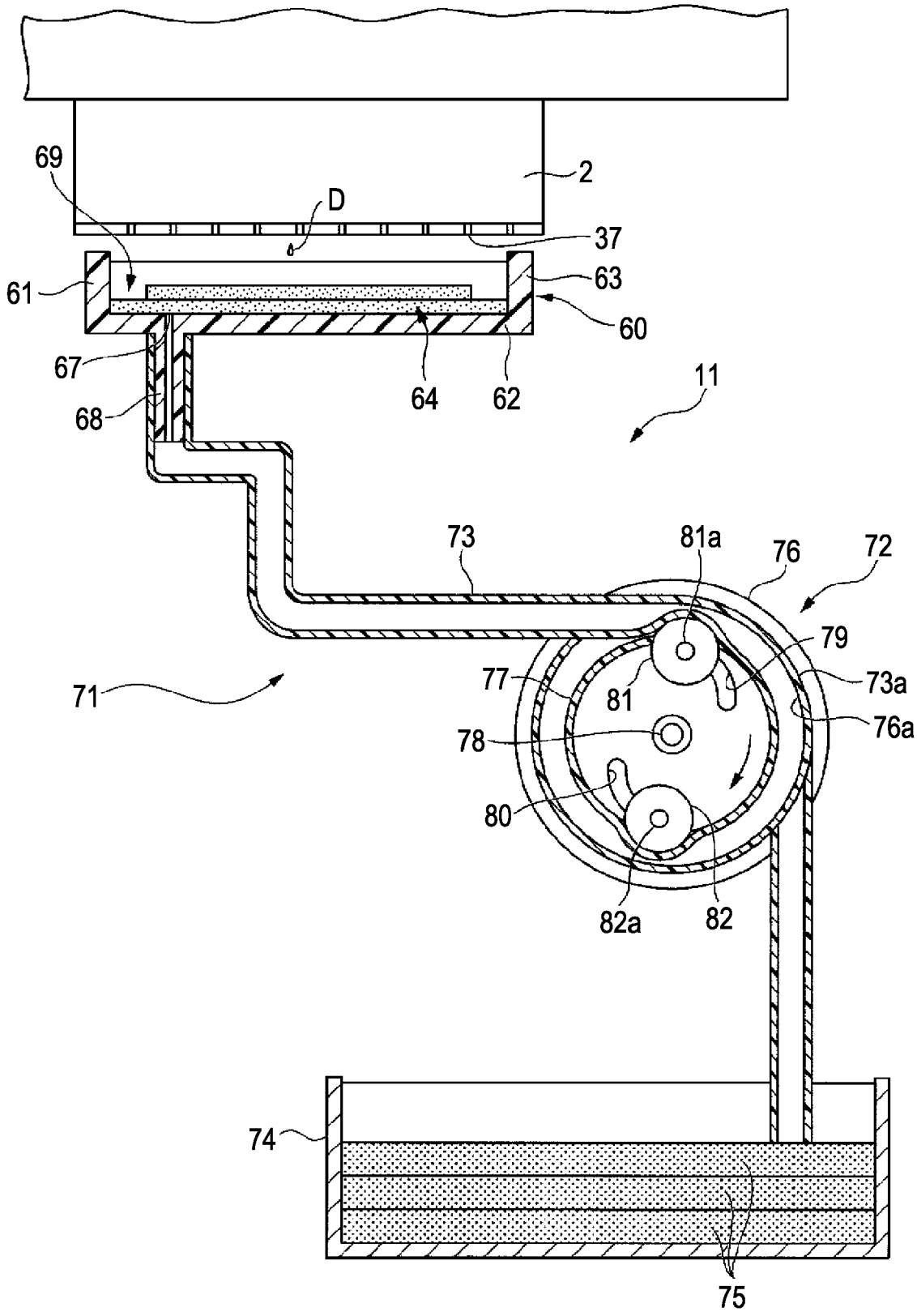
FIG. 5 is a schematic drawing showing a configuration of a suction pump.

FIG. 5 is a drawing showing a configuration of a suction pump connected to the cap member 60.

An ink discharging portion 41 includes an ink discharging channel connected to the cap member 60 for discharging ink accumulated in the cap member 60 and a suction pump 72 for sucking ink accumulated in the cap member 60 to the ink discharging channel.

The suction tube 68 is connected to each branch end of a discharge tube 73 formed of a flexible material which functions as the ink discharging channel, and the other end of the discharge tube 73 is inserted into a waste liquid tank 74. The discharge tube 73 has a sufficient length for allowing the cap member 60 to move along the head 2. A waste liquid absorbing member 75 formed of porous member is stored in the waste liquid tank 74, and collected ink D is absorbed by the waste liquid absorbing member 75.

The suction pump 72 of a tube pump system is disposed between the suction tube 68 and the waste liquid tank 74. The suction pump 72 includes a cylindrical case 76, and a pump wheel 77 having a circular shape in plan view is stored in the case 76 so as to be rotatable about a wheel shaft 78 provided at an axial center of the case 76. An intermediate portion 73*a* of the discharge tube 73 is stored in the case 76 so as to lie along an inner peripheral wall 76*a* of the case 76.

The pump wheel 77 is formed with a pair of roller guide grooves 79 and 80 of an arcuate shape protruding outward arranged so as to oppose to each other with the intermediary of the wheel shaft 78. The roller guide grooves 79 and 80 each have one end positioned on the outer peripheral side of the pump wheel 77 and the other end positioned on the inner peripheral side of the pump wheel 77. In other words, the both roller guide grooves 79 and 80 extend so as to be gradually apart from the outer peripheral portion of the pump wheel 77 from one end to the other end.

A pair of rollers 81 and 82 as pressing means are inserted and supported in the both roller guide grooves 79 and 80 via rotating shafts 81*a* and 82*a*. The both rotating shafts 81*a* and 82*a* are able to slide in the both roller guide grooves 79 and 80.

When the pump wheel 77 is rotated in the normal direction (direction indicated by an arrow), the both rollers 81 and 82 move toward the one end sides of the both roller guide grooves 79 and 80 (the outer peripheral side of the pump wheel 77), and rotate while collapsing (pressing) the intermediate portion 73*a* of the discharge tube 73 in sequence from the upstream side to the downstream side. With this rotation, the interior of the discharge tube 73 on the upstream side of the suction pump 72 is depressurized.

Subsequently, an example of the operation of the printer 1 having the configuration as described above will be described. Here, the operation of the maintenance portion including the sucking operation will be mainly described.

When printed data is transmitted from the outside, the control device develops the received data to ejection data corresponding to the dot pattern, and transmits the same to the head 2. Then, the head 2 carries out a printing process, that is, ejection of ink drops D onto a printing sheet on the basis of the received ejection data.

When it is determined that the operation is to be continued after the printing process, a regular maintenance process is started after having elapsed a preset time. When it is determined that the operation is not to be continued after the printing process, the process of the printer 1 is ended. The case in which it is determined that the operation is to be continued will be described below.

Figure 6:
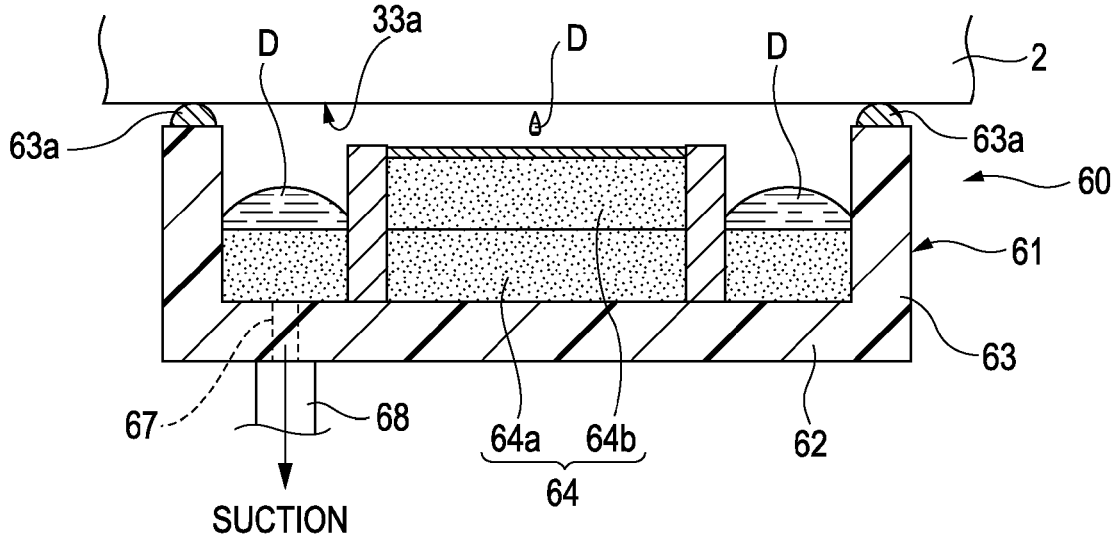
FIG. 6 is an explanatory drawing showing a maintenance operation for an ink jet printer.

When the regular maintenance process is started, the head 2 is moved downward to a maintenance position, and is brought to the proximity of the cap member 60 in such a manner that the head 2 and the sealing member 63*a* oppose to each other. In this state, as shown in FIG. 6, the sealing member 63*a* of the cap member 60 is brought into contact with the head 2. Accordingly, a hermetically sealed space K is defined between the cap member 60 and the head 2, and the nozzle area 33*a* is covered with the cap member 60.

Subsequently, the cap member 60 is moved along the head 2. The suction pump 72 is driven simultaneously with the movement of the cap member 60 to bring the space K into a vacuum state, whereby the ink is sucked from the interior of the head 2. When the space K is brought into the vacuum state, the ink D in the head 2 is discharged. The discharged ink D is absorbed by the absorbing member 64, and is sucked into the groove portion 69 provided with the aperture 67. The ink D runs along the surface of the absorbing member 64 and is stored in the groove portion 69. In particular, the ink D sucked by the sucking operation may be in the form of bubbles and, in this case, the ink D in the form of bubbles is stored. Preferably, part of the ink D in the state of bubbles does not come into contact with the contact surface of the head 2 which comes into contact with the sealing member 63*a*. In other words, it is desirable that the part of the ink D in the form of bubbles does not protrude toward the head 2 from a plane which corresponds to the contact surface of the head 2 which comes into contact with the sealing member 63*a*. This contact breaks the ink D in the form of bubbles, which causes problems such that part of the ink attaches the surface of the head 2, or that the meniscus in the nozzle is broken. However, with the positional relationship as described above, such problems do not occur. The diameter or the maximum width of the ink D in the form of bubbles is preferably smaller than the width of the groove portion 69. In this relationship, even when the ink D in the form of bubbles is broken by an impact occurred when the head 2 and the cap member 60 come into contact with each other, the part of ink is prevented from being attached to the surface of the head 2. Therefore, an effect that the problem of breaking the meniscus in the nozzle is broken does not occur. The ink D stored in the groove portion 69 is absorbed by the absorbing member 64 by continuing the absorbing operation, and is discharged from the cap member 60 via the aperture 67.

Subsequently, the suction pump 72 is inversely driven to release the vacuum space K formed between the cap member 60 and the head 2 to the atmospheric air. By inversely driving the suction pump 72, air flows between the cap member 60 and the head 2, and the space is released to the atmospheric air. After having released to the atmospheric air, the head 2 is moved upward to be apart from the cap member 60. Then, the control device restarts the printing operation on the printing sheet using the head 2. On the other hand, when carrying out the moisturizing operation, the control device carries out the above-described operation in a state of storing the ink D in the cap member 60 by a flashing operation or the like.

In this manner, according to the embodiment, the inner peripheral portion 63*c* laying along the inner surface 63*b* of the frame portion 63 of the cap member body 61, which has the bottom portion 62 and the frame portion 63, is the groove portion 69 having the height from the bottom portion 62 lower than the upper surface of the absorbing member 64, so that waste liquid such as the ink D is stored in the groove portion 69. Accordingly, running of the waste liquid on the cap member body 61 is avoided, and hence attachment of fluid in the nozzle area 33*a* is prevented.

The absorbing member 64 includes the first absorbing layer 64*a* provided over substantially the entire surface in the frame portion 63 and the second absorbing layer 64*b* laminated on the first absorbing layer 64*a* and arranged at the center of the first absorbing layer 64*a* in plan view, and the groove portion 69 is a portion surrounded by the frame portion 63, the first absorbing layer 64*a*, and the second absorbing layer 64*b*. Therefore, waste liquid such as the ink D stored in the groove portion 69 is absorbed by the second absorbing layer 64*b*. In this manner, the waste liquid is prevented from running over the cap member body 61 reliably by absorbing the waste liquid in the groove portion 69.

The technical range of the invention is not limited to the embodiment described above, and modifications may be made as needed without departing scope of the invention.

Figure 7:
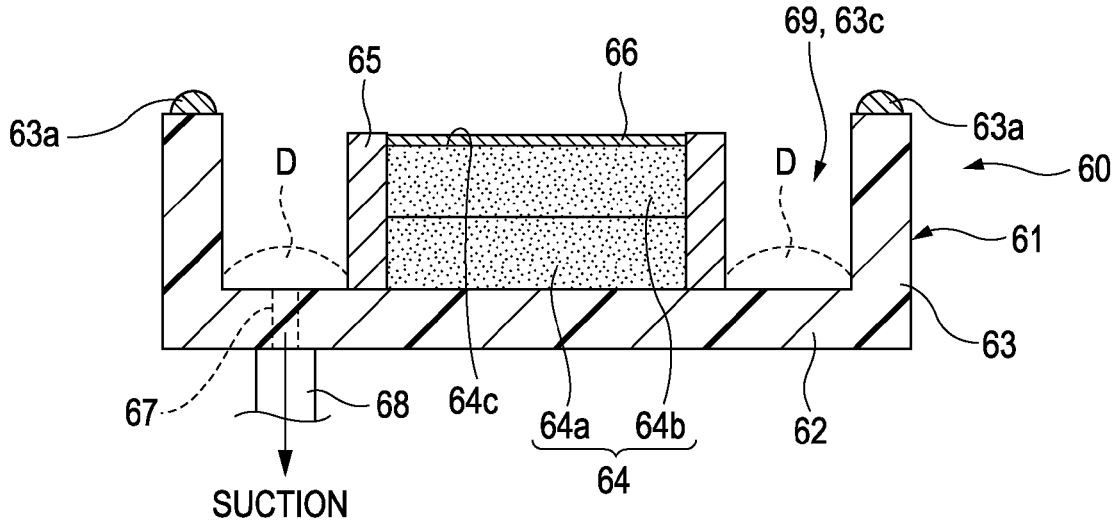
FIG. 7 is a cross-sectional view showing another configuration of the cap member according to the embodiment of the invention.

For example, the absorbing member 64 may be arranged at the center in the frame portion 63 in plan view at a predetermined distance from the frame portion 63, that is, arranged in the area overlapped with the second absorbing layer 64*b* in plan view instead of providing the first absorbing layer 64*a* over the entire area surrounded by the frame portion 63 as shown in FIG. 7. In this configuration, the depth of the groove portion 69 formed between the frame portion 63 and the absorbing member 64 is increased. Accordingly, storage of the ink D in the groove portion 69 is ensured. Alternatively, with the provision of the aperture 67 for suction within the groove portion 69, an advantage such that the ink D in the groove portion 69 is quickly sucked by the sucking operation is achieved as shown in FIG. 7.

In the embodiment shown above, the configuration in which the relative movement between the head 2 and the cap member 60 is realized by moving the head 2 in the vertical direction has been described. However, the invention is not limited thereto. For example, the relative movement between the head 2 and the cap member 60 may be realized by moving the cap member 60 in the vertical direction.

In the embodiment shown above, a configuration in which the head 2 includes five heads corresponding to the respective colors (Y, M, C, K1, K2). The invention is not limited to a head-type ink jet printer, and may be applied to a serial-type ink jet printer. In the embodiment shown above, the description is made about the case in which the ink jet printing apparatus is the ink jet printer. However, the invention is not limited to the ink jet printer, and may be applied to printing apparatuses such as copying machines or facsimile machine.

In the embodiment shown above, the case in which the fluid ejecting apparatus is the fluid ejecting apparatus that ejects fluid such as ink has been described. However, the fluid ejecting apparatus in the invention may be applied to the fluid ejecting apparatus that ejects or discharges liquid other than ink. The fluid which the fluid ejecting apparatus is able to eject includes liquid, liquid-state substances including particles of functional material dispersed or dissolved therein, fluid-state substance such as gel, solid state substances which can be ejected by being flowed as fluid, and powder (toner, for example).

In the embodiment shown above, the fluid to be ejected from the fluid ejecting apparatus is not limited to ink, and fluid corresponding to a specific application is applicable. Manufacture of predetermined devices is achieved by providing an ejecting head which is able to eject fluid corresponding to the specific application on the fluid ejecting apparatus, ejecting the fluid corresponding to the specific application from the ejecting head to attach the fluid to a predetermined substance. For example, the fluid ejecting apparatus in the invention is applicable to the fluid ejecting apparatus which ejects fluid obtained by dispersing (dissolving) material such as electrode material and color material used for manufacturing liquid crystal displays, EL (electroluminescence) displays, and surface emission displays (FEE) in a predetermined dispersion medium (solvent).

The fluid ejecting apparatus also includes a fluid ejecting apparatus which ejects bio organic substances used for manufacturing biochips, or a fluid ejecting apparatus used as a precise pipette which ejects fluid as a sample.

In addition, a fluid ejecting apparatus which ejects lubricant at pinpoint in precise machines such as watches or cameras, a fluid ejecting apparatus which ejects transparent resin liquid such as UV-cured resin on a substrate for forming fine semispherical lenses (optical lenses) used for optical communication element or the like, a fluid ejecting apparatus which ejects etching liquid of oxide or alkali for etching substrates or the like, a fluid ejecting apparatus which ejects gel, a toner-jet printing apparatus which ejects solid state substance exemplified by powder such as toner are also applicable. The invention is applicable to any one of these fluid ejecting apparatuses.

What is claimed is:

1. A cap member that covers a nozzle area of an ejecting head having a plurality of nozzle openings for ejecting fluid, comprising:

a cap member body having a bottom portion and a frame portion, the bottom portion being arranged so as to oppose the nozzle area, the frame portion being provided on a peripheral edge of the bottom portion and coming into contact with the ejecting head; and an absorbing member being fixed to the bottom portion for absorbing the fluid, wherein an inner peripheral portion extending along the inner surface of the frame portion is a groove portion, and the height of the groove portion from the bottom portion is lower than the upper surface of the absorbing member over the entire circumference of the frame portion, wherein the absorbing member includes a first absorbing layer provided over substantially the entire surface in the frame portion and a second absorbing layer laminated on the first absorbing layer and arranged at the center of the first absorbing layer in plan view, and the groove portion is a portion surrounded by the frame portion, the first absorbing layer, and the second absorbing layer.

2. The cap member according to claim 1, wherein the bottom portion is provided with an aperture for sucking at a position corresponding to the groove portion.

3. The cap member according to claim 1, wherein the absorbing member is arranged at the center of the frame portion in plan view with a predetermined distance provided from the frame portion, and air bubbles present in the groove portion are prevented from coming into contact with the ejecting head when the ejecting head and the cap member body come into contact with each other.

4. The cap member according to claim 1, wherein the absorbing member is arranged at the center of the frame portion in plan view with a predetermined distance provided from the frame portion, and the maximum width of the air bubbles present in the groove portion is smaller than the groove portion when the ejecting head and the cap member body come into contact with each other.

5. A fluid ejecting apparatus comprising: an ejecting head having a plurality of nozzle openings for ejecting fluid; and a cap member that covers a nozzle area of the ejecting head having the plurality of nozzle openings, wherein the cap member is the cap member according to claim 1.

6. A cap member that covers a nozzle area of an ejecting head having a plurality of nozzle openings for ejecting fluid, comprising:

a cap member body having a bottom portion and a frame portion, the bottom portion being arranged so as to oppose the nozzle area, the frame portion being provided on a peripheral edge of the bottom portion and coming into contact with the ejecting head; and an absorbing member being fixed to the bottom portion for absorbing the fluid, wherein an inner peripheral portion extending along the inner surface of the frame portion is a groove portion, and the height of the groove portion from the bottom portion is lower than the upper surface of the absorbing member over the entire circumference of the frame portion, wherein the absorbing member is arranged at the center of the frame portion in plan view with a predetermined distance provided from the frame portion, and the groove portion is a portion surrounded by the frame portion, the bottom portion, and the absorbing member.

* * * * *